US008123301B2

(12) United States Patent
Ulstein

(10) Patent No.: US 8,123,301 B2
(45) Date of Patent: Feb. 28, 2012

(54) FASTENING BRACKET

(75) Inventor: Herleif Ulstein, Skodje (NO)

(73) Assignee: Stokke AS (NO)

( * ) Notice: Subject to any disclaimer, the term of this patent is extended or adjusted under 35 U.S.C. 154(b) by 329 days.

(21) Appl. No.: 11/910,372

(22) Filed: Oct. 1, 2007

(65) Prior Publication Data

US 2008/0265650 A1 Oct. 30, 2008

(30) Foreign Application Priority Data

Apr. 1, 2005 (NO) ..... 20051629

(51) Int. Cl.
*A47B 97/00* (2006.01)

(52) U.S. Cl. ..... 297/463.1

(58) Field of Classification Search ..... 24/570, 24/455, DIG. 8; 248/229.1, 229.2, 229.16, 248/231.71, 229.25, 231.85, 316.7; 297/440.22, 297/440.13, 473, 485; 403/385
See application file for complete search history.

(56) References Cited

U.S. PATENT DOCUMENTS

| | | | | |
|---|---|---|---|---|
| 2,778,410 | A * | 1/1957 | Bode | 297/239 |
| 3,904,161 | A * | 9/1975 | Scott | 248/541 |
| 4,744,602 | A | 5/1988 | Campbell et al. | |
| 5,622,345 | A * | 4/1997 | Hopkins | 248/230.5 |
| 7,090,427 | B2 * | 8/2006 | Petratto | 403/400 |
| 2004/0258472 | A1 * | 12/2004 | Petratto | 403/400 |

FOREIGN PATENT DOCUMENTS

| | | | |
|---|---|---|---|
| EP | 0808 593 | A2 | 11/1997 |
| EP | 1792552 | A1 * | 6/2007 |
| NO | 132 782 | C | 1/1976 |

* cited by examiner

*Primary Examiner* — Milton Nelson, Jr.
(74) *Attorney, Agent, or Firm* — Kolisch Hartwell, P.C.

(57) ABSTRACT

A fastening bracket (1) for a chair (2) having two side members (21) and a seat plate (20), an assembly kit for a chair, and the use of the fastening bracket and the assembly kit. The fastening bracket includes an upper beam (10) and a lower beam (11) positioned in parallel over each other and joined in the front edge and rear edge by a front side piece (12) and a rear side piece (13) respectively, the pieces being outside a first space that is formed between the beams (10, 11 The first space receives a side edge of the seat plate (20). A second space is formed between the front and rear side piece (12, 13) and receives a side member (21) of the chair (2). The bracket includes at least one fastening device (14).

13 Claims, 3 Drawing Sheets

FASTENING BRACKET

CROSS-REFERENCE TO RELATED APPLICATIONS

This application is the U.S. national phase of International Application No. PCT/NO2006/000113, which was filed on Mar. 28, 2006, published in English as International Publication No. WO 2006/104391 A1 on Oct. 5, 2006, and the complete disclosure of which is hereby incorporated by reference for all purposes.

The present invention relates to a fastening bracket for a chair, such as a chair with two side members and a seat plate, e.g. a children's chair with the possibility for adjusting the seat plate. Further, the invention relates to an assembly kit for a chair and the use of the fastening bracket and the assembly kit.

BACKGROUND OF THE INVENTION

It is common knowledge that young children, i.e. children of the age from where they can sit upright alone (app. 6-7 months) until they overcome sitting safely in a children's chair without falling out (app. 2 years), need harnesses that keeps them from falling out of children's chairs.

Conventional harnesses are often employed, of such type which comes with a pram, children's chair or which can be bought separately. In children's chairs, the harnesses are often anchored by straps on both sides of the seat in fitted fastening device, such as eyelets or the like.

In the last few years, there has been a development towards more countries and regions having their own safety requirements for equipment to be used for children, such as children's chairs and harnesses. This is taken into account when developing new children's chairs, but it can be difficult to adjust chairs that have been produced over a long period of time, prior to such safety demands came into force. It is particularly difficult to carry out such adaptations on chairs that have already been sold for several years and there are thousands of children's chairs existing in individual homes.

This is the case with the children's chair Tripp Trapp®, developed as early as 1972 and patented in 1976, and which still is a very popular children's chair in many countries. The chair is designed to be adjusted in accordance with the body size of the child and thus has a seat plate and a foot rest which can be moved into various height positions by sliding into grooves in the side members and are locked by tightening the distance between the side members. The seat plate can be further adjusted in depth position in that the plate may slide in relation to the back rest, and thereby providing the child using the chair the correct seat length under its thighs.

Thus, it has proven difficult to adapt existing seats to new requirements, particularly e.g. requirements wherein the anchor for the children's harness should follow the height position of the seat by a certain distance, such as for example 75 mm between the mentioned parts, and/or for example being kept constant in depth relation to the back rest.

Further, it has been an object to provide a fastening device as extra equipment so that also owners of older chairs may upgrade their chairs. It has also been an object to avoid physical operations such as making holes in any of the parts or inserting screws which leave spoiling marks in the chair that will show when the children's harness is no longer needed.

DESCRIPTION OF THE INVENTION

In order to obtain these objectives, the applicant has developed a fastening bracket that solves all the above mentioned problems.

The bracket comprises a closed hoop form having a horizontal groove in order to receive a side edge of the seat plate of the chair, and an approximate vertical cocked groove for receiving a vertical diagonal side member of the chair. Thus, the bracket is crosswise locked in that the vertical and the horizontal components of the chair lock the bracket indirectly when these are locked in relation to each other.

Thus, the invention relates to a fastening bracket for a chair comprising two side members and seat plate, characterized in that it includes an upper beam and a lower beam positioned in parallel over each other and being joined in the front edge and rear edge by a front side piece and a rear side piece respectively, said pieces being outside a first space that forms between the beams, wherein said first space receives a side edge of the seat plate and wherein a second space which forms between the front and rear side piece receives a side member, and wherein the bracket comprises at least one fastening device.

The invention will now be described in further detail by means of examples of embodiments and the attached figures, none of which are meant to restrict the scope of the invention which is only defined by the patent claims enclosed.

DETAILED DESCRIPTION

Figure 1:
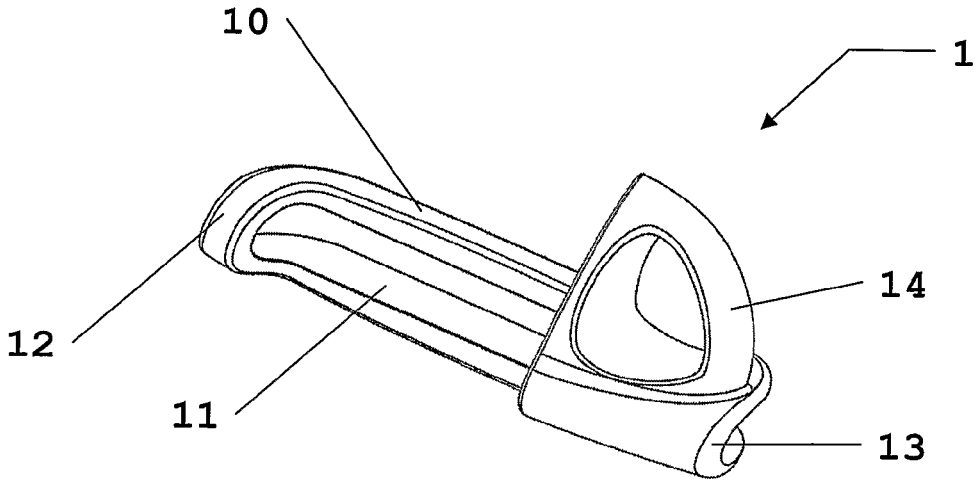
FIG. 1 shows a perspective view of the fastening bracket.

As can be seen in FIG. 1, the bracket 1 comprises an upper beam 10 and a lower beam 11 situated in parallel above each other, forming a first space there between. The beams are linked together in the front edge and rear edge by a front side piece 12 and a rear side piece 13 respectively, forming a second space there between, situated on the outside of the first space defined between the beams 10 and 11. In this embodiment, the side pieces 12 and 13 are additionally arched both on the outer and inner sides. Alternatively, one or both side pieces 12 and/or 13 may be completely or partially formed by fastening devices which assemble the beams 10 and 11, such as screws, bolts or clips (not shown), such as should the beams 10 and 11 not be permanently assembled, but be delivered in two or more parts.

The bracket can be manufactured in any suitable material, such as metal, wood, plastic or other synthetic material or composite material.

On the upper side of the rear side piece 13, a fastening device 14 is situated, which in this case is an eye, serving for anchoring of a children's harness, such as by use of a snap hook, a strap or the like. However, the fastening device may be situated anywhere on the bracket 1, such as on the upper side, the bottom side in the rear edge or the front edge or all positions in between, as long as it does not intervene with the components of the chair.

Figure 2:
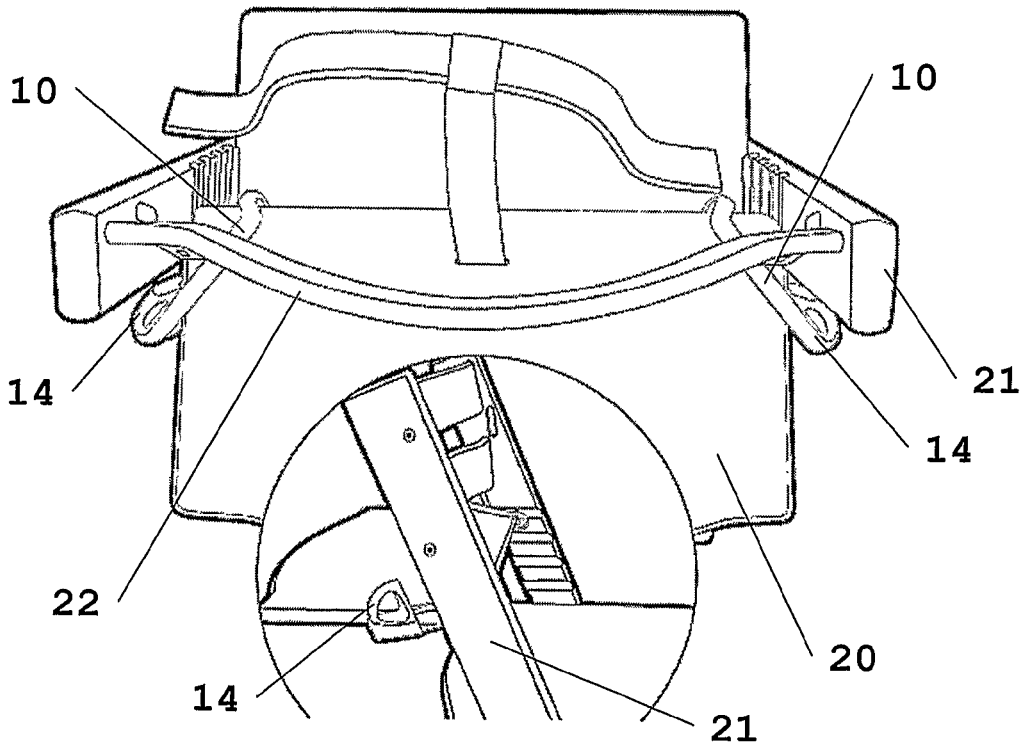
FIG. 2 shows an installation drawing seen from above with an inlaid side perspective.

With the above-mentioned embodiment of the bracket, the first space, in the form of an open groove, is formed between the beams 10 and 11, wherein the vertical distance between said beams is adjusted to the thickness of the seat plate 20 of the chair, to which the bracket 1 is to be fastened. As can be seen from FIG. 2, the seat plate 20 of the chair can be loosened and pushed out, e.g. at the rear of the chair, so that two brackets 1 according to the invention may be installed, e.g. by being thread over both the right and left front corner of the seat plate 20. The two brackets must in this case be symmetrical, a right- and a left hand bracket, as the side member 21 of the chair is diagonal. By pushing the seat plate 20 forward to the desired position, the brackets will slip into position on each side of the side members 21 of the chair, as the second space receives the side member 21. Alternatively, the brackets can temporarily be held in place or be fastened to the side members 21 of the chair, and thereafter the seat plate can be pushed into place.

In this embodiment, the front side piece 12 and the rear side piece 13 are cocked in order to adapt to the vertical diagonal side member 21 of a Tripp Trapp® chair.

Further, the vertical transitions, between the side pieces 12 and 13 and the horizontal beams 10 and 11, abutting the side member 21, are rounded in order to be accurately adapted around the side member 21, so that there will be no slack or gaps wherein the child can squeeze its fingers. As can be seen from FIGS. 1 and 2, the vertical front part of the fastening device 14 also follows this groove shape from the rear side piece 13, towards to the side member 21 so that the bracket 1 is as tightly fastened as possible to the chair.

Figure 3:
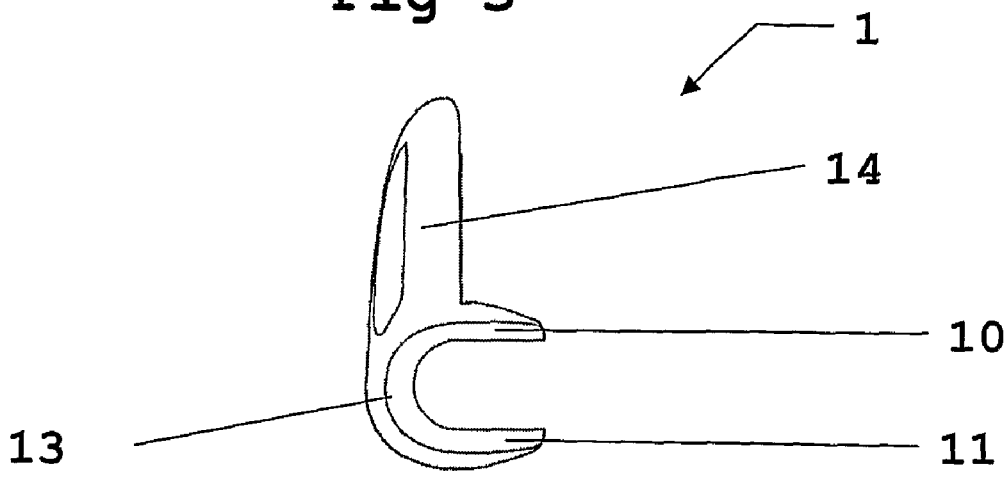
FIG. 3 shows a planar rear view of the bracket.
Figure 4:
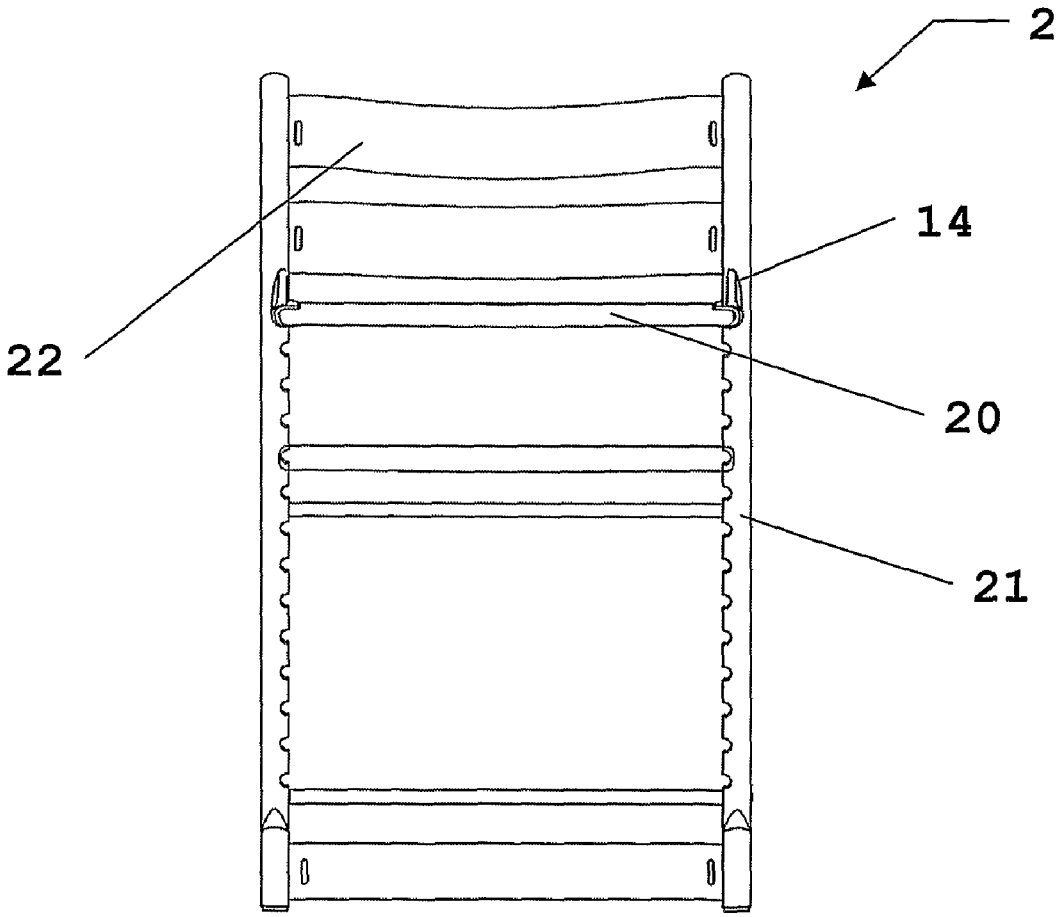
FIG. 4 shows the bracket of FIG. 3 installed in a chair.

In FIG. 3, the fastening device 14 is in this case shown to protrude some distance above the upper beam 10, which for example may be a requirement according to certain regulations. From FIG. 4 it can be seen that the bracket can be used regardless of the height in which the seat plate 20 is positioned, and that the height position of the fastening device 14 in relation to the seat plate 20 will always be the same. The fastening device 14 can possibly be situated on other parts of the bracket as mentioned above, and be adapted to contact other surfaces against the components of the chair. Possibly, the bracket 1 can comprise several fastening devices.

Figure 5:
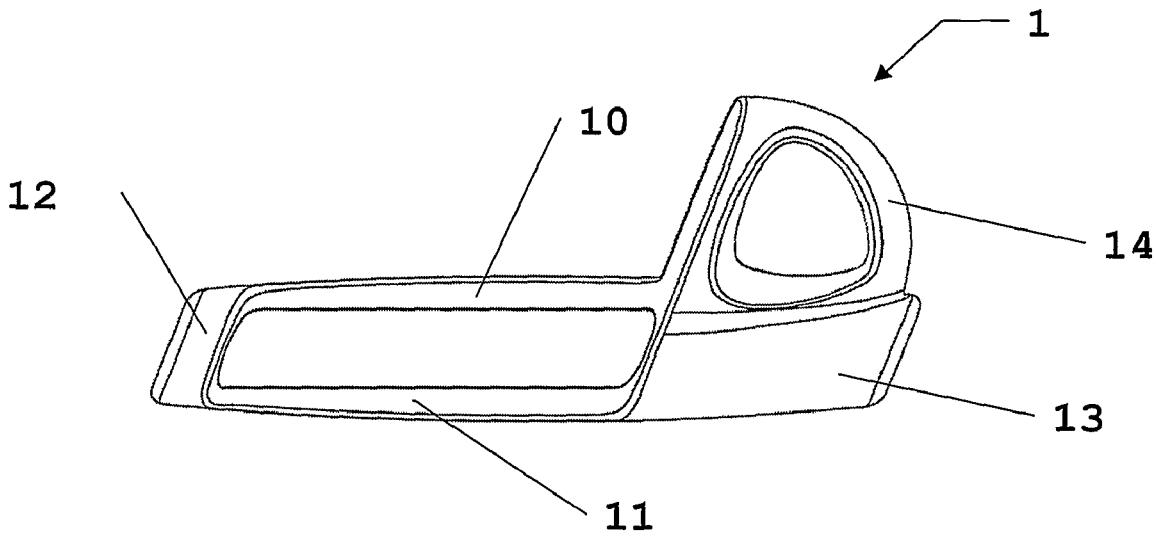
FIG. 5 shows a planar view of the bracket seen from the outside.
Figure 6:
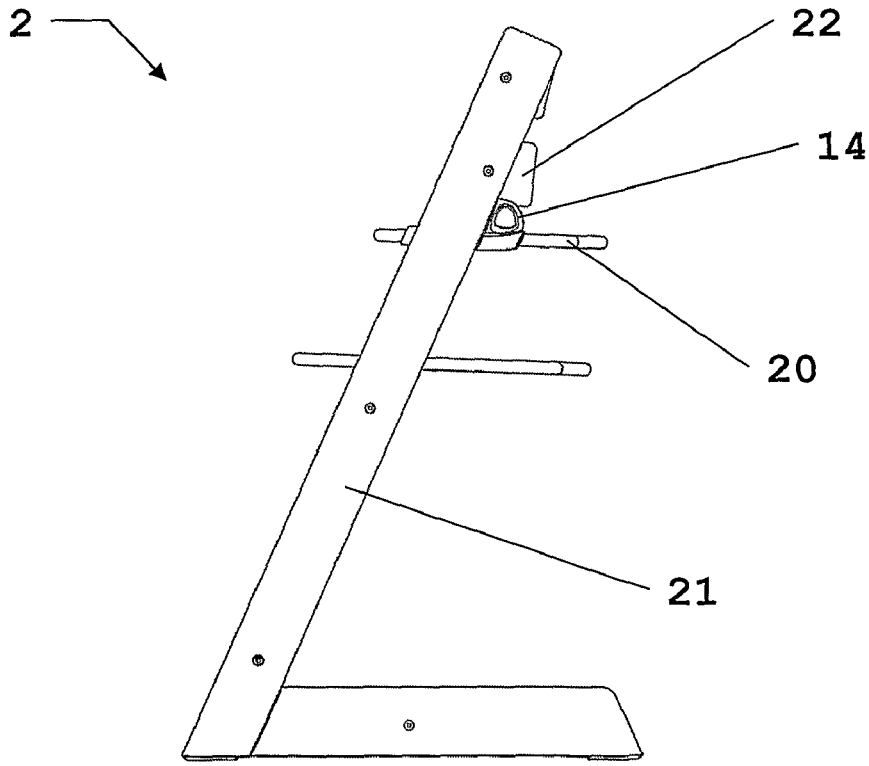
FIG. 6 shows the bracket of FIG. 5 installed in a chair.

In FIGS. 5 and 6, one can easily see how the bracket is locked by the vertical diagonal side member 21, and that the bracket allows for adjustment of the depth of the seat plate 20 in relation to the back rest 22.

The advantage with the bracket according to the present invention is thus, that it can be employed on an existing chair, such as the Tripp Trapp® chair or other chairs, without making any physical changes on any of the parts of the chair, or by using fastening devices such as screws. The bracket is locked crosswise only by means of the existing components. The bracket follows the regulation of the chair both vertically and horizontally, such as regulation of the height of seat plate or footrest, or regulation of the depth of the seat plate or footrest, without hindering any of the functions of the chair. The bracket can easily be removed after use or be moved to another corresponding chair when it is no longer needed. It can also be used with the foot rest.

The bracket according to the present invention is preferably supplied in pairs of two brackets for a chair, especially symmetrical pairs adapted to the shape of the chair and particularly to the side members of the chair. The present invention therefore also concerns an assembly kit for chair, comprising two symmetrical fastening brackets according to what is claimed.

The present invention also relates to the use of a fastening bracket as claimed or an assembly kit as claimed for the installation of a safety harness in a children's chair, such as a Tripp Trapp chair.

Possibly, the bracket can be employed for other purposes in addition to or instead of anchoring a child harness. For example, it can be employed for fastening a bag or a knap sack, or toys in a strap, which the children can play with when it tires from eating or when the chair is used by larger children.

The invention claimed is:

1. A fastening bracket (1) for a chair (2) that includes two side members (21) and a seat plate (20), the fastening bracket comprising:

a longitudinal upper beam (10) and a longitudinal lower beam (11) positioned in parallel over each other and defining a first space therebetween;

said upper beam (10) and lower beam (11) being joined at longitudinal ends thereof by a front side piece (12) and at opposite longitudinal ends thereof by a rear side piece (13);

said front side piece (12) and rear side piece (13) being outside said first space and defining a second space therebetween, wherein the second space is outside the first space;

wherein said first space is adapted to receive a side edge of the seat plate (20) and said second space is adapted to receive a side member (21) of the chair (2);

and wherein the fastening bracket further comprises at least one first fastening device (14) adapted to anchor a children's harness therethrough.

2. The fastening bracket according to claim 1, wherein at least one of the front side piece (12) and the rear side piece (13) is adapted to follow the edge shape of the seat plate (20) of the chair (2).

3. The fastening bracket according to claim 1, wherein when the side member (21) of the chair is disposed at an angle so as to be vertically diagonal, at least one of the front side piece (12) and the rear side piece (13) is adapted to be oriented vertically diagonal at substantially the same angle as the side member (21).

4. The fastening bracket according to claim 1, wherein vertical transitions between the side pieces (12, 13) and the horizontal beams (10, 11) are adapted to follow the edge shape of the side member (21) when the fastening bracket is abutting the side member (21).

5. The fastening bracket according to claim 1, wherein the fastening bracket comprises one continuous member.

6. The fastening bracket according to claim 1, wherein the first fastening device (14) is one of an eye, a snap-hook, and a loop.

7. The fastening bracket according to claim 6, wherein the first fastening device (14) is an eye.

8. The fastening bracket according to claim 1, wherein the first fastening device (14) is situated on one of an upper side of the fastening bracket, a lower side of the fastening bracket, a side of the rear side piece (13), a side of the front side piece (12), and outer sides of the upper beam (10) and lower beam (11).

9. The fastening bracket according to claim 8, wherein the first fastening device is situated on the upper side of the rear side piece (13).

10. The fastening bracket according to claim 1, wherein at least one side piece comprises a second fastening device configured to bind the beams (10, 11) together.

11. The fastening bracket according to claim 10, wherein the second fastening devices include screws, bolts or clips.

12. An assembly kit for a chair, comprising two symmetrical fastening brackets according to any of claims 1 to 4.

13. A method of installing a safety harness in a children's chair, comprising using a fastening bracket according to any of claims 1 to 4.

* * * * *